US006209638B1

(12) United States Patent
Mikolajczyk

(10) Patent No.: US 6,209,638 B1
(45) Date of Patent: Apr. 3, 2001

(54) CASING ACCESSORY EQUIPMENT

(76) Inventor: Raymond F. Mikolajczyk, 1031-B Pierre Washington Rd., Broussard, LA (US) 70518-1078

( * ) Notice: Subject to any disclaimer, the term of this patent is extended or adjusted under 35 U.S.C. 154(b) by 0 days.

(21) Appl. No.: 09/303,478

(22) Filed: Apr. 30, 1999

(51) Int. Cl.[7] ..... E21B 17/10
(52) U.S. Cl. ..... 166/241.1; 166/244.6
(58) Field of Search ..... 166/241.1, 241.6, 166/177.4, 241.7, 192

(56) References Cited

U.S. PATENT DOCUMENTS

| | | | | |
|---|---|---|---|---|
| 1,998,833 | * | 4/1935 | Crowell | 166/177.4 |
| 3,200,884 | * | 8/1965 | Solum et al. | 166/241.6 |
| 3,358,768 | * | 12/1967 | Solum | 166/241.6 |
| 5,566,757 | * | 10/1996 | Carpenter et al. | 166/177.4 X |
| 5,575,333 | | 11/1996 | Lirette et al. . | |

* cited by examiner

*Primary Examiner*—Frank Tsay
(74) *Attorney, Agent, or Firm*—Jesse D. Lambert

(57) ABSTRACT

Casing accessory equipment especially adapted for restricted diameter applications. The present invention comprises casing accessory equipment, including casing string centralizers, float shoes and float collars, comprising a tubular member having a recessed central section with enlarged diameter end sections. A bow spring centralizer comprising two spaced apart bands connected by a plurality of circumferentially positioned bow spring blades is mounted in the central section. A plurality of lugs are disposed on the recessed central section. Windows in the bands fit over the lugs, restraining rotational and longitudinal movement of the bow spring centralizer within the central recessed section. The bow spring centralizer may collapse to a diameter substantially equal to the diameter of the enlarged end sections, and in the collapsed position retains some longitudinal movement within the central recessed section. In the float shoe and float collar, a cast insert and one way valve in the float shoe and float collar permits fluid pump-through, while preventing fluid flow-back.

11 Claims, 5 Drawing Sheets

CASING ACCESSORY EQUIPMENT

BACKGROUND—FIELD OF THE INVENTION

The present invention relates generally to accessory equipment for oilfield tubular strings, especially casing strings used in casing earth boreholes drilled for oil and natural gas production. More specifically, the present invention relates to casing accessory equipment, including casing string centralizers and "float" equipment used in cementing the casing strings in place, which have bow spring centralizers mounted thereon such that the centralizers may collapse and permit the accessory equipment to readily pass through tight annular clearances (such as through wellheads and the like) no larger than the largest body diameter of the accessory equipment, then permit the centralizers to spring back out to properly centralize the casing string in open hole or a larger casing string.

BACKGROUND—RELATED ART

Earth boreholes drilled for oil and natural gas wells typically have one or more "casing strings" run and cemented in place during the course of the drilling program. A typical drilling sequence is to drill a length of open hole in the earth (perhaps several thousand feet in length), then lower a casing string having an outer diameter somewhat smaller than the diameter of the drilled hole to a position usually near the bottom of the open hole section. The casing string (which also may be several thousands of feet long) is usually comprised of a number of joints, each being on the order of forty feet long, connected to one another by threaded connections or other connection means. Cement is then pumped down through the inner bore of the casing, exits the bottom of the casing, and is displaced upwardly to a desired "cement top" depth in the annulus between the casing and the open hole. The cement supports and anchors the casing in place, and (ideally) forms a hydraulic bond between the casing string and the wall of the borehole. It is important, then, for the cement to be displaced to the required depth, and for the casing to be substantially centered in the borehole, so that a uniform cement sheath may be formed around the casing string (that is, if the casing were touching the borehole wall on one side, a cement bond could not be formed at that location).

Several types of casing accessory equipment assist in properly placing the cement so as to ensure a good hydraulic bond between the casing string and the wall of the borehole. "Float equipment" (which includes float shoes and float collars) includes usually relatively short (perhaps three to four feet long) sections of tubular member, with the bore of the tubular member having a casting therein, in which a check or one-way valve is seated. Usually, a "float shoe" is affixed to the very bottom end of the casing string; one or more joints of casing, referred to as "shoe joints" are then made up above the float shoe; then a "float collar" is made up, with the remainder of the casing string made up to complete the casing string. The one way valves in the float shoe and float collar permit cement (and other fluids) to be pumped down through the casing string, out the casing shoe and up around the casing string, but prevent any flow back into the casing string. The outer diameter of the tubular member used in float equipment is typically somewhat larger than the nominal diameter of the casing string to which it is attached, typically roughly equal to the diameter of the casing "collars" which comprise part of the threaded connections between casing joints.

"Centralizers" are often mounted on casing strings to center the casing string in the borehole and obtain a uniform thickness cement sheath around the casing string. The centralizers provide blades (of different possible configurations, as discussed herein) extending out from the casing wall and contacting the borehole, thereby holding the casing string off of direct contact with the borehole, and substantially centralizing the casing therein. To accomplish that goal, the centralizer blades typically form a total centralizer diameter roughly the diameter of the borehole in which the casing string is run.

Different types of centralizers have been used. One type comprises a solid central tubular body having a plurality of solid blades integral with the central body, the blades extending out to the desired diameter. Yet another type in use for many years are "bow spring" centralizers, which typically comprise a pair of spaced-apart bands which can be opened to encircle a casing string, then locked in place on the casing; and a number of outwardly bowed, resilient bow spring blades connecting the two bands, spaced around the circumference of the bands. The configuration of bow spring centralizers permits the bow spring blades to at least partially collapse as the casing string is run into the borehole and passes through any restricted diameter location, such as a piece of equipment having an inner diameter smaller than the at-rest bow spring diameter, then spring back out after passage through the reduced diameter equipment. One type of casing accessory equipment which comprises a bow spring centralizer is a "casing string centralizer", which comprises a relatively short tubular member (on the order of three to four feet), which is made up into the casing string at selected locations over its length. However, even when collapsed, a conventional bow spring centralizer mounted on a casing string presents a diameter necessarily larger than the nominal casing diameter.

Centralization of a casing string near its bottom end, in particular around the float equipment, is usually considered especially important to securing a uniform cement sheath and consequently a hydraulic seal around the bottom end of the casing string. Toward that end, placement of centralizers very near or even on the float equipment is desirable.

The advent of drilling offshore wells in very deep water depths has given rise to arrangements of subsea wellheads, casing strings and the like with very tight clearances for passage of casing strings therethrough. Often, drilling devices such as underreamers and bi-center (or eccentric) drill bits are used to drill a borehole below a given casing string, in which the borehole has a diameter greater than the inner diameter of the casing string above the open hole section being drilled. Although it is desirable to centralize the succeeding casing string, including the casing float equipment, when the succeeding casing string is run, mounting a conventional bow spring centralizer on the casing and on conventional float equipment (which as described above, typically has an outer diameter somewhat larger than the nominal casing diameter) usually results in a diameter (even with the centralizer collapsed) too large to permit passage of such float equipment through restricted diameter passageways. In addition, such conventionally mounted bow spring centralizers do not shield the bands of the centralizers from scraping and catching on obstructions, ledges and the like, which pose further serious problems.

It is an object, then, of the present invention to provide improved casing accessory equipment especially adapted for use in situations where casing strings must be run through very close clearance passages. It is a further object of the present invention to provide casing accessory equipment, in particular casing string centralizers and float equipment, having a reduced diameter central section with a bow spring centralizer mounted in the reduced diameter central section, wherein the bow spring centralizer may be collapsed to a diameter no greater than that of the float equipment, and wherein the bow spring centralizers are "dragged" through tight clearance locations rather than being "pushed" therethrough. It is a further object of the present invention to provide casing accessory equipment in which the bands of the bow spring centralizers are shielded from catching on obstructions. Further objects of the present invention will become apparent through a reading of the ensuing description and the drawings.

SUMMERY OF THE PRESENT INVENTION

The casing accessory equipment of the present invention comprises an elongated, hollow tubular member having a central recessed section and an enlarged section on each end. A bow spring centralizer is mounted on the tubular member in the central recessed section. The bow spring centralizer comprises a pair of spaced apart bands which fit closely about and encircle the central recessed section of the tubular member, while still being movable on the tubular member. A plurality of outwardly-bowed, resilient bow spring blades connect the two bands, and are spaced around the circumference of the two bands. A plurality of lugs are fixed to the tubular member in the central recessed section. Windows in the bands fit over the lugs, thereby restricting the rotational and longitudinal movement of the bow spring centralizers within the central recessed section. The dimensions, spacing and configuration of the windows, lugs, and bow spring blades and bands are such that some longitudinal back-and-forth movement of the bow spring centralizer on the central body is permitted, even when the bow spring blades are fully collapsed. The diameters of the enlarged end sections are generally equal to or somewhat larger than the diameter of the bands, so that the bands are shielded from catching on obstructions when being run in the wellbore. When used as float equipment, the bore of the tubular member has an insert therein holding float one or more one way valves, for single-direction fluid flow therethrough.

DETAILED DESCRIPTION OF THE PRESENTLY PREFERRED EMBODIMENTS

Figure 1:
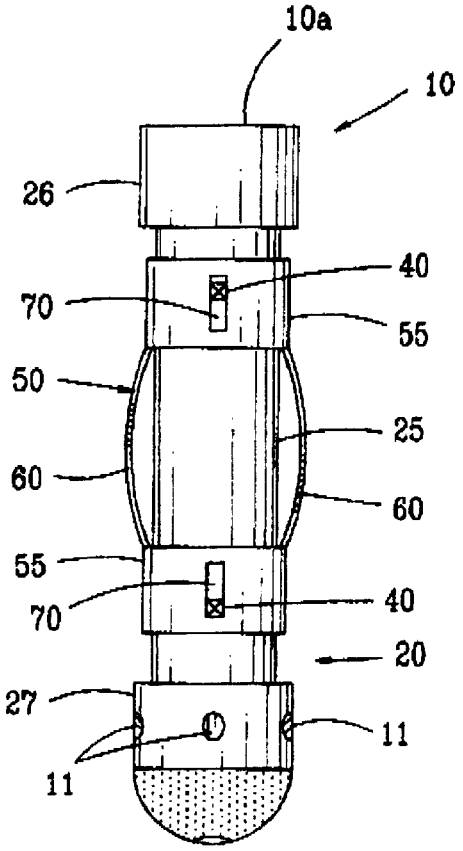
FIG. 1 is a view of one embodiment of the casing accessory equipment of the present invention, in particular a float shoe.

Although various embodiments of the present invention are contemplated, with reference to the drawings several presently preferred embodiments are herein described.

In the float shoe embodiment, with reference particularly to FIGS. 1 through 3*a*, the casing accessory equipment of the present invention comprises a float shoe 10 having an elongated tubular member 20 having a central bore 30. Typically, tubular member 20 is on the order of three to four feet long, but may be of any desired length. Tubular member 10 is typically of a metal alloy similar to that of the casing string to which it is attached; however, any variety of metals or metal alloys, well known in the art, may be used.

Upper end 10*a* of tubular member 20, in the presently preferred embodiment, is adapted to be connected to a casing string via threaded connection 40. However, it is understood that other types of connections, for example "snap collar" connections, or even means such as welding and the like, may be used.

Tubular member 20 has a central recessed section 25, thereby forming enlarged diameter sections 26 and 27 at each end. Central recessed section 25 provides a location for the bow spring centralizer to be placed, as will be later described, while permitting the total diameter of the tool at the location of the centralizer to be no greater than that of the larger diameter end sections 26 and 27. Central recessed section 25 may be formed by turning down the nominal diameter of tubular member 20, or may be formed by forging, casting or other means well known in the art. End sections 26 and 27 typically have a diameter somewhat larger than the nominal diameter of the casing string to which float shoe 10 is attached, and typically roughly equal to the diameter of the collars which comprise part of the threaded connections between joints of the casing string, and generally equal to or somewhat larger than the diameter of the bands 55 (described below). In one embodiment, seen in FIGS. 1 through 3*a*, angled holes 11 permit fluid flow in an angled upward direction, or "up-jet" action.

A plurality of lugs 40 are disposed about the circumference of central recessed section 25, and in the presently preferred embodiment the lugs are arranged in two spaced-apart groups, so as to form two spaced apart sets of four lugs each, disposed about the circumference of central recessed section 25. In particular, FIGS. 2, 3 and 3*a*, which omit the bow spring centralizers (hereinafter described), show the presently preferred embodiment of the arrangement of lugs 40. Although four lugs are depicted in each set, it is understood that a greater or lesser number of lugs may be used. Lugs 40 may be formed by leaving metal in place during the forming of central recessed section 25; or by fixing sections of metal on the outer surface of central recessed section 25 by welding, brazing, by the use of threaded connections or pins, or other means known in the art.

Bow spring centralizer 50 comprises a pair of spaced apart bands 55 connected by a plurality of outwardly-bowed bow spring blades 60. Bands 55 are typically metal, with bow spring blades 60 of spring steel. Both ends of bow spring blades 60 are connected to bands 55 by welding or other like means. Each of bands 55 has a number of windows 70, which number may be one or more to provide a sufficient number of windows to accommodate the number of lugs 40, as will be described. Bow spring centralizer 50 may be mounted on central recessed section 25 in several manners. Bands 55 may be hinged to permit bands 55 (and consequently bow spring centralizer 50) to be opened up, placed around central recessed section 25, then pinned closed to lock bow spring centralizer 50 thereon. Alternatively, bands 55 could be cut, bow spring centralizer 50 placed around central section 25, then welded together again. By whatever method of attachment, bow spring centralizer 50 is mounted so that windows 70 fit over lugs 40, as shown in FIG. 1, thereby restraining the rotational and longitudinal movement of bow spring centralizer 50 within central recessed section 25.

Figure 2:
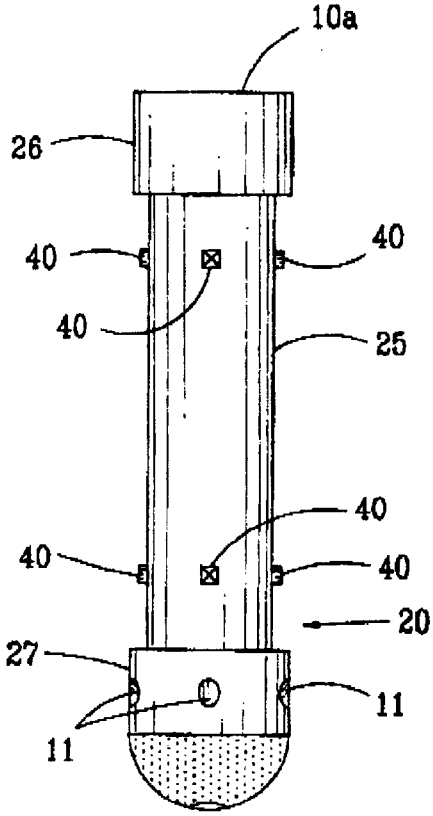
FIG. 2 is a view of the float shoe of the present invention, without the bow spring centralizer in place.
Figure 3:
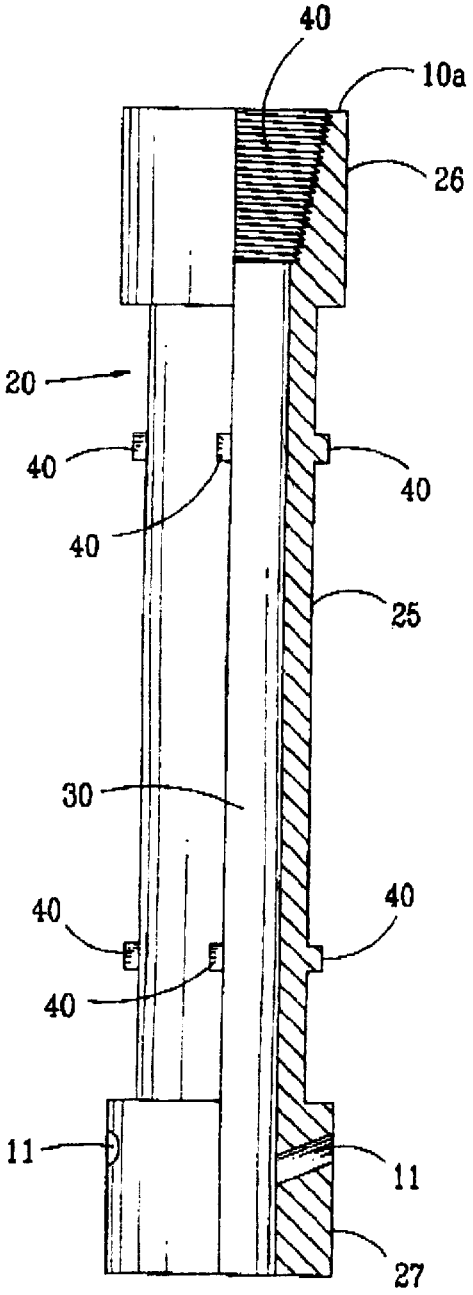
FIG. 3 is a cross section view of the float shoe of the present invention, without the cast insert and the bow spring centralizer.
Figure 3A:
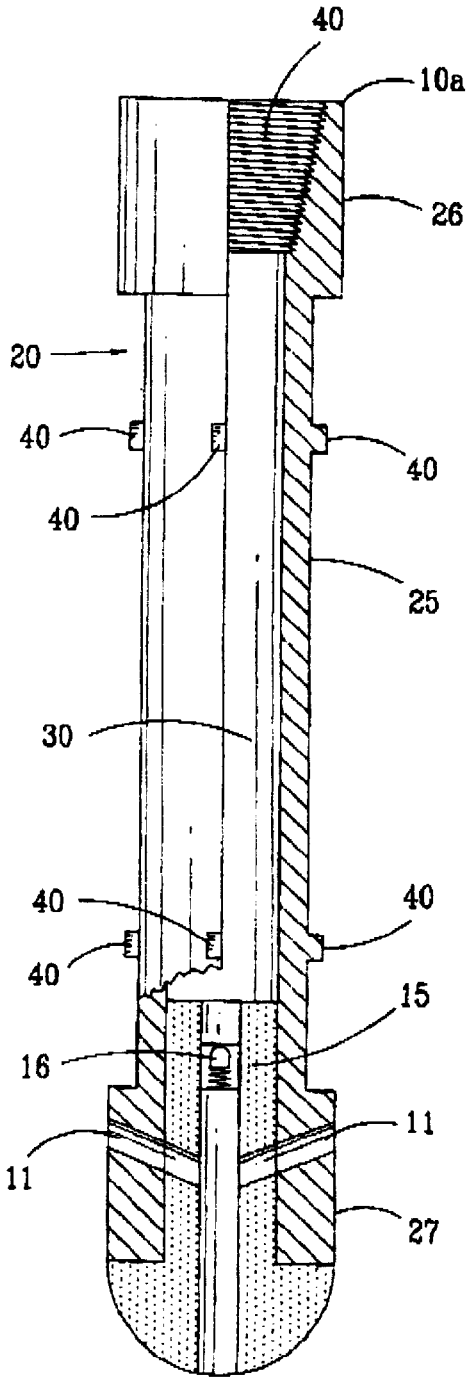
FIG. 3*a* is a cross section view of the float shoe without the bow spring centralizer, showing the insert and check valve in place.
Figure 4:
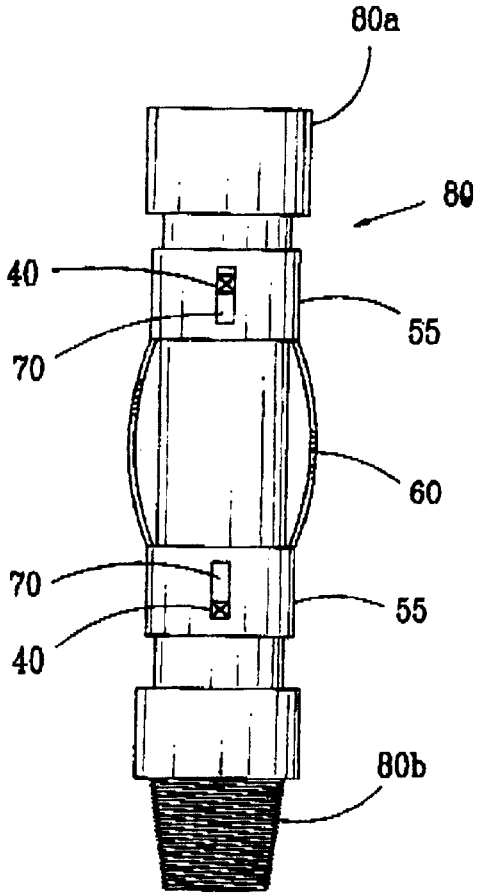
FIG. 4 is a view of another embodiment of the casing accessory equipment of the present invention, in particular a float collar.
Figure 5:
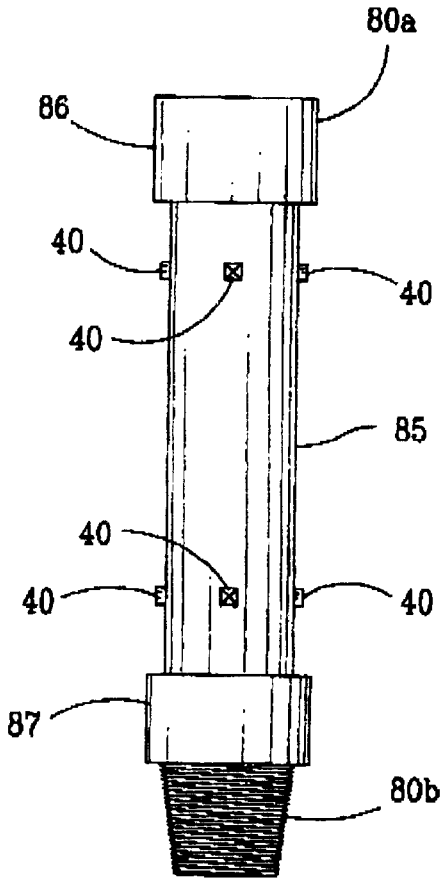
FIG. 5 is a view of the float collar of the present invention, without the bow spring centralizer in place.
Figure 6:
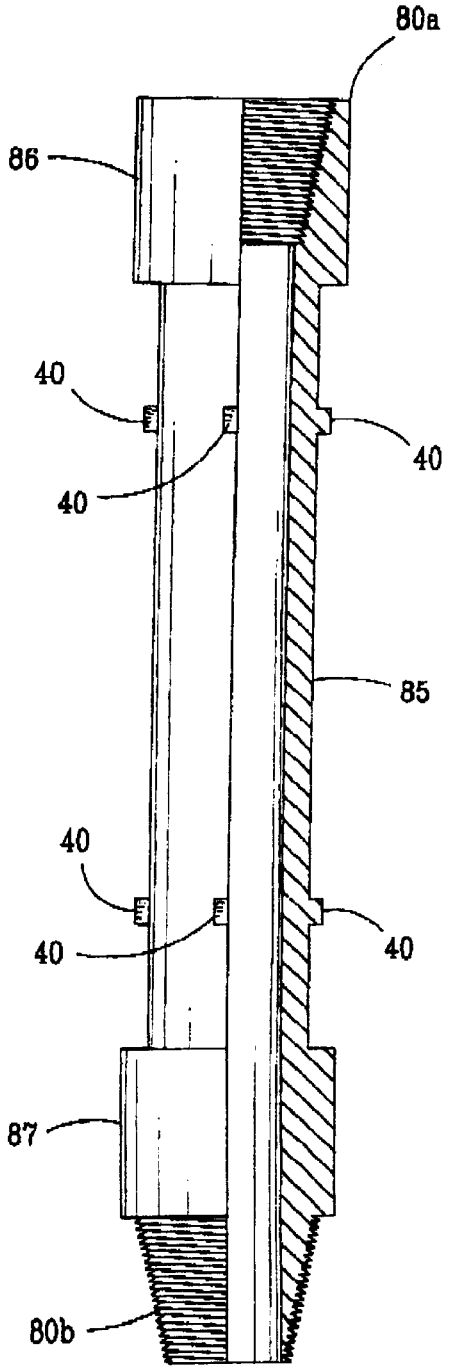
FIG. 6 is a cross section view of the float collar of the present invention, without the cast insert and the bow spring centralizer.
Figure 6A:
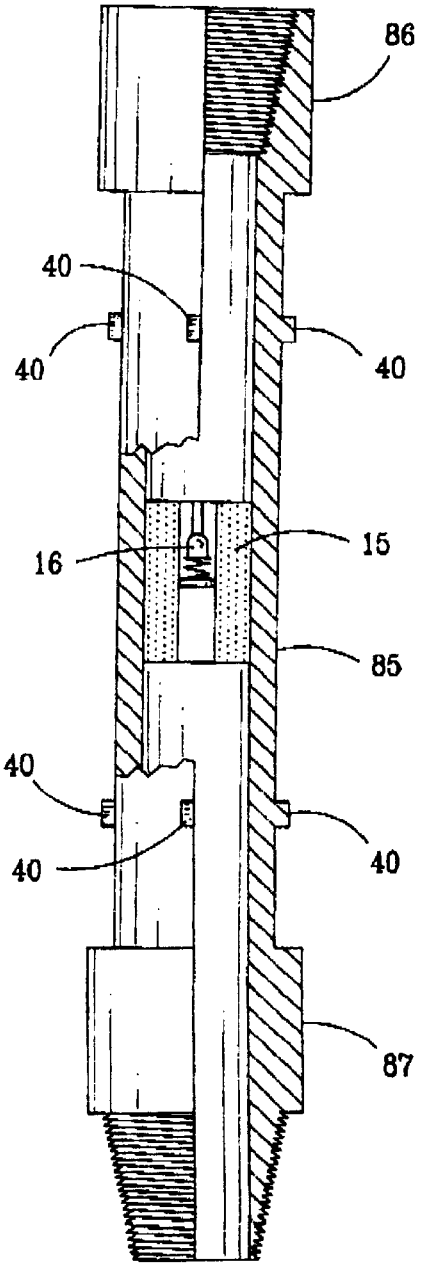
FIG. 6*a* is a cross section view of the float collar, without the bow spring centralizer and showing the insert and check valve in place.

FIG. 2 shows float shoe 10 without bow spring centralizer mounted thereon, for clarity. FIG. 3 is a cross-section of float shoe 10, showing placement of lugs 40 and other elements of the apparatus. FIG. 3*a* is a partial cross section of float shoe 10, including insert 15 and one way valve 16. Insert 16 may be of cement or other suitable composite material, which may be cast in place within the bore 30 of float shoe 10.

Figures 7A, 7B, 7C, 7D:
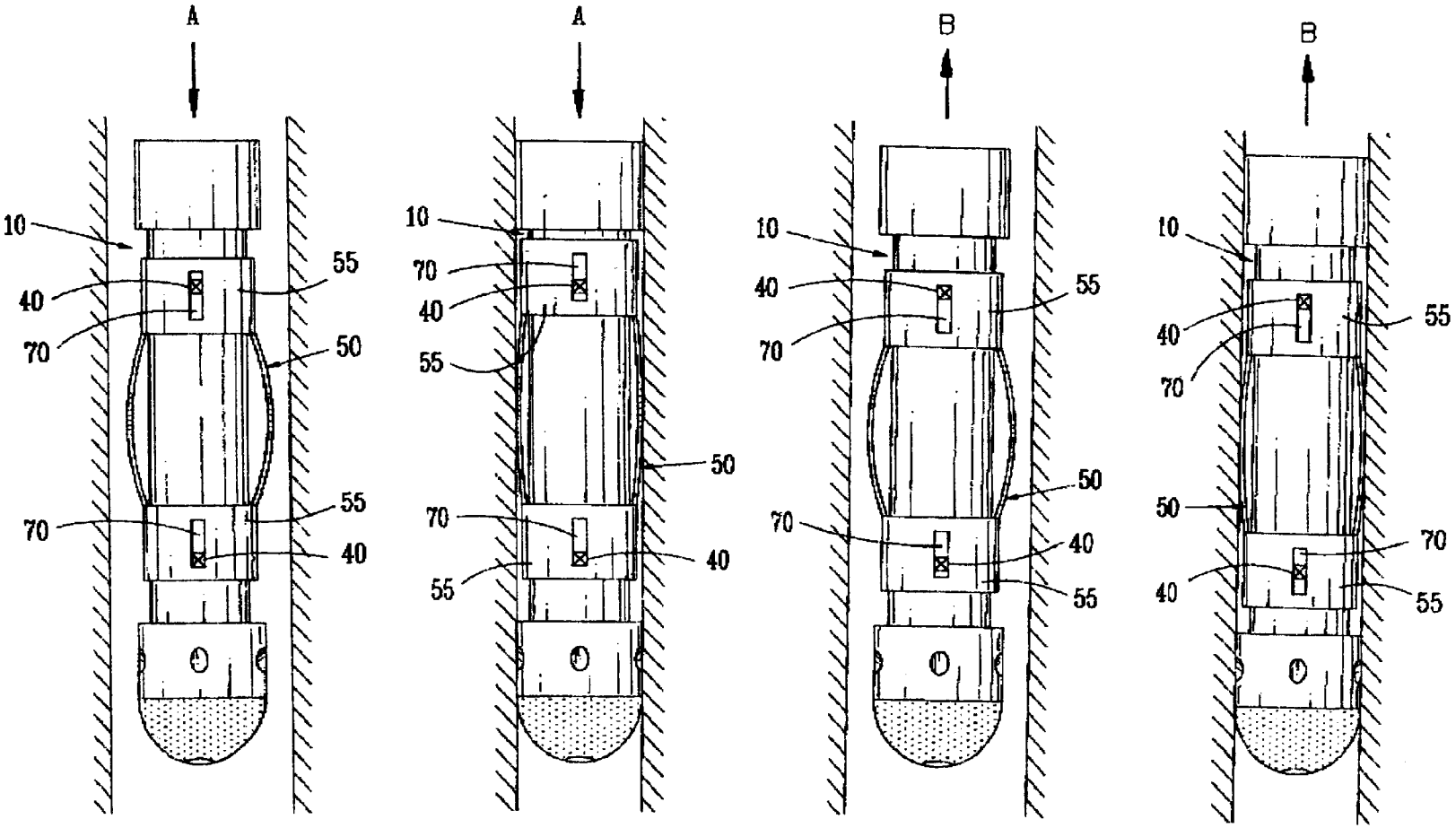
FIGS. 7*a*–7*d* are views of the float shoe of the present invention, in different modes of being pushed into or pulled out of a borehole.

With reference to FIGS. 7*a* through 7*d*, several key aspects of the present invention while in use are shown, in particular with the float shoe embodiment (it is understood that a similar sequence would apply to the float collar embodiment of the present invention, as well). In FIG. 7*a*, float shoe 10 is moving downhole in the direction of arrow A. Bow spring centralizer 50 is "relaxed", in that the diameter of the passageway is sufficient to accommodate its maximum diameter, while being moved downhole due to contact with lowermost set of lugs 40. In FIG. 7*b*, a restricted diameter passageway has been encountered. Bow spring centralizer 50 is "dragged" through the restriction by the lowermost set of lugs 40 engaging the lowermost set of windows 70, while bow spring centralizer 50 at least partially collapses. As bow spring centralizer 50 collapses, the spacing between bands 55 increases, and the size, configuration, and spacing of lugs 40, and bow spring centralizer 50, including windows 70 and bands 55 permits bow spring centralizer 50 to fully collapse without uppermost windows 70 contacting uppermost lugs 40, as can be seen in FIG. 7*b*. This "dragging" action, as opposed to "pushing" the centralizer (as would happen if bow spring centralizer would be forced downhole by contact with uppermost set of lugs 40), eases passage of the bow springs through the restricted diameter passage. The size, configuration, and spacing of the different components of the invention, including lugs 40, windows 70, bands 55, and bow spring blades 60 are such that even when bow spring centralizer 50 is substantially completely collapsed to accommodate a small diameter passageway, some amount of longitudinal movement of the bands 55 (and consequently bow spring centralizer 50) is still possible. It can be seen in FIGS. 7*a* and 7*b* that enlarged end sections 26 and 27, having a diameter equal to or somewhat larger than the diameter of bands 55, shield bands 55 from obstructions and the like.

FIGS. 7*c* and 7*d* show a similar sequence, with float shoe 10 now being pulled upward in the direction of arrow B. In FIG. 7*c*, the passageway is of sufficient diameter that bow spring centralizer 50 is relaxed. When a restricted diameter passageway is encountered, as in FIG. 7*d*, bow spring centralizer 50 is dragged rather than pushed through the restricted diameter section, this time by contacting the uppermost set of lugs 40.

Another presently preferred embodiment of the present invention is shown in FIGS. 4, 5, 6, and 6*a*, in this embodiment a float collar 80. In FIGS. 4, 5, 6, and 6*a*, where applicable, like parts have like part numbers with the float shoe embodiment. In general, float collar 80 has both upper and lower ends 80*a* and 80*b* adapted for connection to a casing string (via threaded connection or other means well known in the art), as opposed to float shoe 10, which typically has only an upper end 10*a* adapted for connection to a casing string. Float collar 80 comprises central recessed section 85 and larger diameter end sections 86 and 87. As seen particularly in FIGS. 5, 6 and 6*a*, float collar 80 also comprises lugs 40, and an insert 15 and one way valve 16.

It is to be understood that the sequence of running float collar 80 through a various diameter passageways is substantially the same as the sequence described above for float shoe 10 in FIGS. 7*a* through 7*d*.

The casing string centralizer of the present invention may be readily understood from the above description of float shoe 10 and float collar 80. The casing string centralizer is essentially the configuration of float collar 80, both ends of which are adapted for connection to a casing string, and without the insert and one way valve.

Although the above description contains many specificities, these should not be construed as limiting the scope of the invention but as merely providing illustrations of some of the presently preferred embodiments of this invention. For example, various materials could be used for the different parts of the invention; dimensions may be varied to suit given applications; different numbers of lugs and placement at different locations on the central recessed section is possible; and different numbers of bow spring blades may be used, etc.

Thus the scope of the invention should be determined by the appended claims and their legal equivalents, rather than by the examples given.

I claim:

1. An improved wellbore casing accessory, comprising:

a) an elongated tubular member having a bore therethrough, a central recessed section and enlarged diameter end sections, at least one end of said tubular member adapted to connect to a casing string, a diameter of said central recessed section being substantially equal to a diameter of said casing string;

b) a plurality of lugs disposed on an outer surface of said central recessed section of said tubular member in two longitudinally spaced-apart positions, at least one of said plurality of lugs in each of said positions; and c) a bow spring centralizer mounted in said central recessed section of said tubular member, said bow spring centralizer comprising a pair of spaced apart bands encircling said central recessed section of said tubular member, each of said bands having at least one window therein disposed over one of said lugs, and a plurality of circumferentially spaced, outwardly bowed bow spring blades connecting said pair of bands, wherein sizing and spacing of said lugs, said windows, said bands, and said bow spring blades results in said bow spring centralizer being dragged when said wellbore casing accessory is forced through a passageway having a diameter less than a diameter of said bow spring centralizer at rest, and only one band is in longitudinal contact with a lug at any one time, and wherein a diameter of said bow spring centralizer when fully collapsed and a diameter of said bands is no greater than a diameter of said enlarged diameter end sections.

2. The apparatus of claim 1, further comprising an insert and one way valve disposed in said bore of said tubular member.

3. The apparatus of claim 2, wherein said apparatus is a float shoe.

4. The float shoe of claim 3, further comprising a plurality of upwardly-angled passages disposed circumferentially about a lower end of said float shoe.

5. The apparatus of claim 2, wherein said apparatus is a float collar.

6. An improved casing accessory adapted for passage through reduced diameter passageways, comprising:

a) an elongated tubular member having a bore therethrough, a central recessed section and enlarged diameter end sections, at least one end of said tubular member adapted to connect to a casing string;

b) a plurality of lugs disposed on an outer surface of said central recessed section of said tubular member, said lugs placed so as to form a pair of longitudinally spaced-apart sets; and c) a bow spring centralizer mounted in said central recessed section of said tubular member, said bow spring centralizer comprising a pair of spaced apart bands encircling said central recessed section of said tubular member, each of said bands having at least one window therein disposed over one of said sets of said lugs, and a plurality of circumferentially spaced, outwardly bowed bow spring blades connecting said pair of bands, wherein when said bow spring blades are substantially fully collapsed, a diameter of said bow spring centralizer is no greater than a diameter of said enlarged diameter end sections, and when said bow spring blades are collapsed to a diameter substantially equal to an outer diameter of said enlarged diameter end sections, said bow spring centralizer is capable of at least some longitudinal back-and-forth movement.

7. The apparatus of claim 6, further comprising a cast insert and a one way valve disposed in said bore.

8. The apparatus of claim 7, wherein said apparatus is a float shoe.

9. The apparatus of claim 7, wherein said apparatus is a float collar.

10. An improved casing accessory adapted for passage through reduced diameter passageways, comprising:

a) an elongated tubular member having a bore therethrough and an outer central section, at least one end of said tubular member adapted to connect to a casing string, said central section having an outer diameter substantially equal to said casing string;

b) a plurality of lugs disposed on an outer surface of said central section of said tubular member, at least two of said lugs in longitudinally spaced-apart position from one another on said outer surface; and c) a bow spring centralizer mounted in said central section of said tubular member, said bow spring centralizer comprising a pair of longitudinally spaced apart bands encircling said central section of said tubular member, each of said bands having at least one window therein disposed over at least one of said lugs, and a plurality of circumferentially spaced, outwardly bowed bow spring blades connecting said pair of bands, wherein when said casing accessory is in movement, only said band leading in the direction of movement of said casing accessory is in axial contact with said lugs, thereby pulling said bow spring centralizer in said direction of movement.

11. The casing accessory of claim 10, wherein said tubular member comprises at least one enlarged diameter section positioned outside of one of said bands, said enlarged diameter section axially positioned so that said band does not contact said enlarged diameter section.

* * * * *